US008627899B2

(12) United States Patent
Gabrielsson et al.

(10) Patent No.: US 8,627,899 B2
(45) Date of Patent: Jan. 14, 2014

(54) HANDLE PORTION OF A HAND-HELD MOTOR-DRIVEN TOOL

(75) Inventors: Annica Gabrielsson, Huskvarna (SE); Lars Andersson, Nässjö (SE)

(73) Assignee: Husqvarna AB, Huskvarna (SE)

( * ) Notice: Subject to any disclaimer, the term of this patent is extended or adjusted under 35 U.S.C. 154(b) by 538 days.

(21) Appl. No.: 12/596,385

(22) PCT Filed: Apr. 27, 2007

(86) PCT No.: PCT/SE2007/000416
§ 371 (c)(1),
(2), (4) Date: May 25, 2011

(87) PCT Pub. No.: WO2008/133554
PCT Pub. Date: Nov. 6, 2008

(65) Prior Publication Data
US 2012/0012352 A1 Jan. 19, 2012

(51) Int. Cl.
*B25D 17/04* (2006.01)

(52) U.S. Cl.
USPC ..... 173/162.1; 173/162.2; 30/381

(58) Field of Classification Search
USPC ..... 173/162.1, 162.2; 30/381, 382, 383; 81/489
See application file for complete search history.

(56) References Cited

U.S. PATENT DOCUMENTS

| | | | | |
|---|---|---|---|---|
| 4,138,812 | A | 2/1979 | Zimmerer | |
| 4,694,578 | A * | 9/1987 | Kemmler | 30/383 |
| 4,856,195 | A * | 8/1989 | Grossmann et al. | 30/369 |
| 4,964,217 | A | 10/1990 | Siede | |
| 5,960,549 | A | 10/1999 | Höppner | |
| 6,016,604 | A * | 1/2000 | Wolf et al. | 30/383 |
| 6,178,642 | B1 * | 1/2001 | Schaer | 30/216 |
| 6,427,641 | B1 | 8/2002 | Ziegs | |
| 6,779,514 | B2 * | 8/2004 | Zimmermann et al. | 123/556 |
| 6,799,373 | B2 * | 10/2004 | Menzel et al. | 30/381 |
| 8,210,276 | B2 * | 7/2012 | Krondorfer et al. | 173/162.2 |
| 2001/0010122 | A1 * | 8/2001 | Taomo et al. | 30/383 |

FOREIGN PATENT DOCUMENTS

SE 421682 B1 1/1982

* cited by examiner

*Primary Examiner* — Alexandra Elve
*Assistant Examiner* — Nathaniel Chukwurah
(74) *Attorney, Agent, or Firm* — Novak Druce Connolly Bove + Quigg LLP

(57) ABSTRACT

A handle portion for a hand-held motor-driven tool and a hand-held motor-driven tool including a base portion (20), a rear handle (30) arranged to the rear part (20*a*) of the base portion (20) and a front handle (40) having a first end (40*a*) attached to the base portion (20) and a second end (40*b*) attached to the base portion (20). At least a part of the front handle (40) is arranged as a loop starting from a first lateral face (20*c*) extending in a direction away from a lower face (20*e*) of the base portion (20) and further in a direction towards a second lateral face (20*d*). A first attachment means (12) for attaching the first end (40*a*) and a second attachment (13) means for attaching the second end are mountable at the same face of the first lateral face (20*c*), second lateral face (20*d*) or lower face (20*e*) of the base portion.

11 Claims, 8 Drawing Sheets

HANDLE PORTION OF A HAND-HELD MOTOR-DRIVEN TOOL

TECHNICAL FIELD

The present disclosure relates to a handle portion of a hand-held motor-driven tool, and especially to an arrangement for fastening a front handle to a base portion of a handle portion of a hand-held motor-driven tool. The disclosure also relates to a hand-held motor-driven tool comprising a handle portion and a drive portion.

BACKGROUND

A hand-held motor-driven tool has a handle portion and a drive portion, wherein the handle portion is arranged to the drive portion via anti-vibration elements such that vibrations in the drive portion are prevented from propagating into the handle portion and further into the body of a person handling the tool. U.S. Pat. No. 6,842,987 shows an example of such a hand-held motor-driven tool in the form of a chain saw, comprising a handle unit and a drive unit. The handle unit described in U.S. Pat. No. 6,842,987 has a rear handle and a front handle to facilitate that a person handling the tool can hold the tool in both hands: one hand holding the rear handle and the other hand holding the front handle. The rear handle and the front handle are attached to a base portion of the handle unit, which base portion extends under the drive unit. The front handle has a first end attached in a first point to a side of the base portion via screws, as could be seen in FIGS. 1 and 6 of U.S. Pat. No. 6,842,987. The front handle extends from its first end over and around the drive unit to the underside of the drive unit, where a second end of the front handle is attached in a second point to the underside of the base portion. Thereby, it is possible for the user to change grip and hold the tool properly and comfortably also if the tool is tilted.

When mounting such a prior art front handle to a base portion of a handle unit, the first end of the front handle is fastened to the base portion by using two screws, which are screwed into the first end of the front handle and further into the side of the base portion. Thereafter, the tool is turned around and two more screws are screwed into the second end of the front handle and further into the underside of the base portion, for fastening the second end of the front handle with the base portion of the handle unit. This mounting process results in a rather long assembly time for the handle unit. Consequently, there is a need for an arrangement of a handle unit, which arrangement results in a short assembly time when assembling a front handle to a base portion of a handle unit.

SUMMARY

An object of the invention is to achieve a handle portion of a hand-held motor-driven tool, which handle portion has a short assembly time.

Since the handle portion is arranged such that the first and second attachment means for attaching the first and second end of the front handle to the base portion are mountable at the same face of the base portion, the handle portion does not have to be turned when it is mounted. Thereby, a quick, reliable and cost-efficient mounting can be achieved.

According to an embodiment of the first aspect of the invention, the first attachment means and the second attachment means are mountable at the first lateral face, and the base portion is provided with a recess for receiving the second end of the front handle, the recess extending from the second lateral face in a direction towards the first lateral face, through a limited portion of the base portion. Hereby, a stable and solid arrangement of the second end of the front handle to the base portion is received, since load onto the handle portion is received by the second end of the front handle and the base portion and not only by an attachment means. Also, only one screw can be used for achieving a stable and solid attachment of the second end of the front handle to the base portion, resulting in a short assembly time, lower weight of the tool and a more cost-efficient tool, compared to if two or more screws were used to attach the second end of the front handle to the base portion.

According to another embodiment, the recess of the base portion is provided with at least one groove, and the second end of the front handle is provided with at least one protrusion, which at least one protrusion is arranged to co-operate with the at least one groove. By using such a protrusion and groove combination, the attachment of the second end of the front handle in the recess of the base portion is stabilized even more, since torsion forces are received by the protrusion and groove combination. In an alternative of this embodiment, two such protrusion and groove combinations are used, which are placed opposite to each other, for achieving a very stable attachment of the front handle in the base portion.

According to yet another embodiment, the at least one groove comprises a first, flattened groove extending in the direction of the recess along the whole extension of the recess, and the at least one protrusion of the front handle comprises a first protrusion arranged to co-operate with the first groove. By using such a flattened groove protrusion combination, the insertion of the second end of the front handle in the recess is facilitated when the handle portion is mounted.

According to another embodiment of the invention, the first end of the front handle is provided with at least one cavity and the base portion is provided with at least one projection arranged to co-operate with the at least one cavity, the at least one cavity and the at least one projection being arranged to correspond with each other. Thereby, only one first attachment means can be used for fastening the first end of the front handle to the base portion and still achieve a stable attachment between the first end of the front handle and the base portion. By only using one first attachment means instead of two attachment means as in prior art, the time for assembling the handle portion is shortened. Also, the weight of the tool is lowered and the tool becomes more cost-efficient.

According to a variant of this embodiment, the at least one projection of the base portion comprises at least two projections each having a different cross-sectional shape, and wherein the at least one cavity of the first end of the front handle comprises at least two cavities, each cavity having inner dimensions corresponding with the inner dimensions of one of the projections, such that each cavity co-operate with its corresponding projection. By having different cross-sectional shape for each projection-cavity combination, a more solid and stabilized attachment is achieved, since one cavity-projection combination has a play in a direction that the other cavity-projection combination does not have a play, and vice versa.

According to still another embodiment of the invention, the first end of the front handle is attached to the first lateral face of the base portion and the second end of the front handle is arranged at the lower face of the base portion. By arranging the second end of the front handle to the lower face of the base portion instead of to the second lateral face, the hand-held motor-driven tool can be carried conveniently for a user regardless if the tool is rotated from a horizontal position. The user can change grip on the front handle depending on the angle of rotation such that the gravitational force of the tool is received conveniently for the user.

According to yet another embodiment of the invention, the first end of the front handle is attached to the rear part of the base portion, and the second end of the front handle is attached to the front part of the base portion. Thereby, the attachment points for the first and the second ends of the front handle to the base portion can be distributed around the centre of gravity of a tool onto which the handle portion is arranged, such that a user of the tool can handle the tool properly and comfortably.

According to a second aspect of the invention, a hand-held motor-driven tool is provided comprising a drive portion and a handle portion according to the first aspect of the invention. By arranging the handle portion such that the attachment means for attaching the first and second end of the front handle to the base portion are mounted at the same face of the base portion, the hand-held motor-driven tool including the handle portion and the drive portion does not have to be turned when the handle portion is mounted to the drive portion in the same step as the mounting of the handle portion. Thereby, a quick, reliable and cost-efficient mounting can be achieved.

BRIEF DESCRIPTION OF THE DRAWINGS

Embodiments of the invention will in the following be described in more detail with reference to the enclosed drawings, wherein.

DESCRIPTION OF EMBODIMENTS

Figure 1:
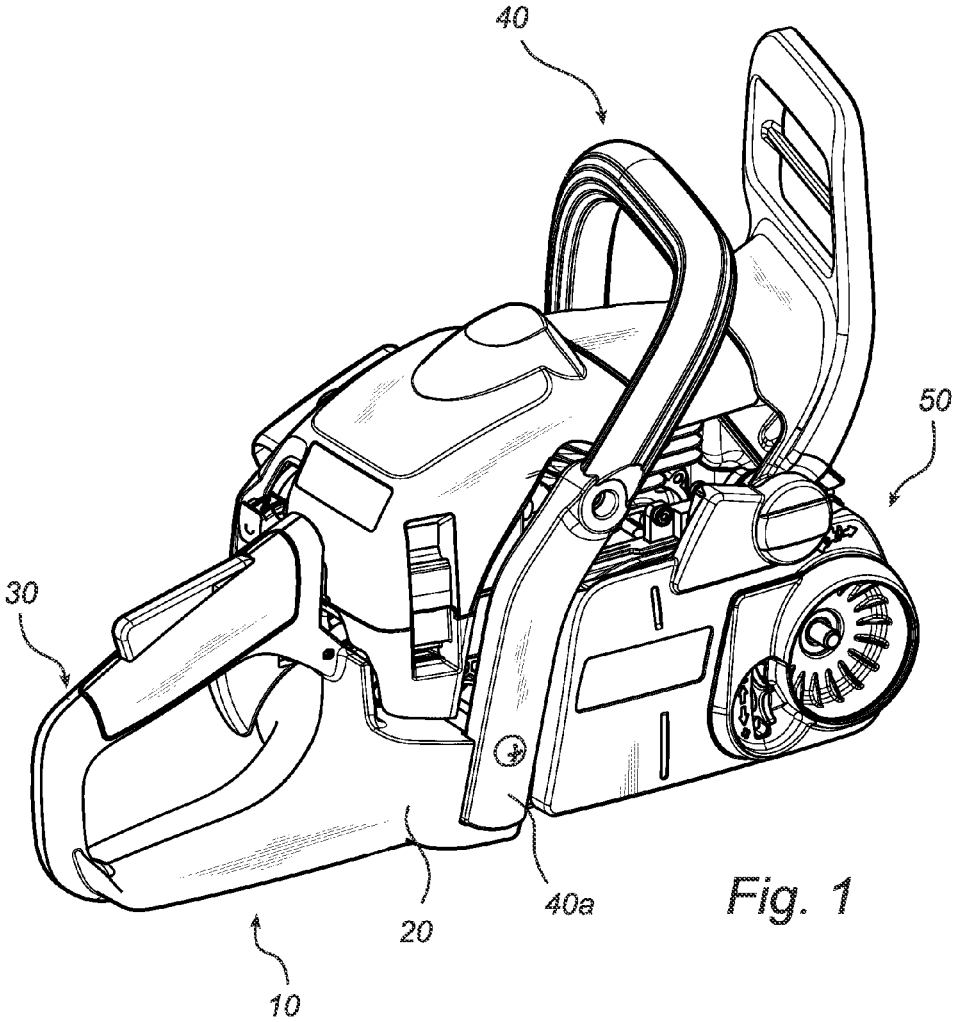
FIG. 1 shows a perspective, schematic view of a chain saw comprising a handle portion and a drive portion.

Embodiments of the present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

In FIG. 1, a handle portion 10 according to one embodiment of the invention is shown, arranged on a chain saw. The chain saw further comprises a drive portion 50 including an internal combustion engine. The handle portion 10 is preferably arranged to the drive portion via anti-vibration elements (not shown). The handle portion 10 comprises a base portion 20, a rear handle 30 integrally arranged with the base portion 20, and a front handle 40. The front handle 40 is arranged with its first end 40*a* to a lateral face of the base portion. The front handle 40 extends from its first end 40*a* away from the base portion 20, further over the drive portion 50, then further in a direction towards a second lateral face of the base portion, where a second end 40*b* of the front handle is attached to the second lateral face and a lower face, which is an underside, of the base portion (see e.g. FIG. 3). Thereby, the front handle 40 extends over and around the drive portion. This permits a comfortable handling of the chain saw in most possible usage situations. For example, if a user of the chain saw needs to tilt the saw, the user can change his grip on the front handle to a position where the saw is held such that the drive portion is positioned below the position of the hand holding the front handle, such that the gravitational force of the drive portion is conveniently received by the user.

Figure 2:
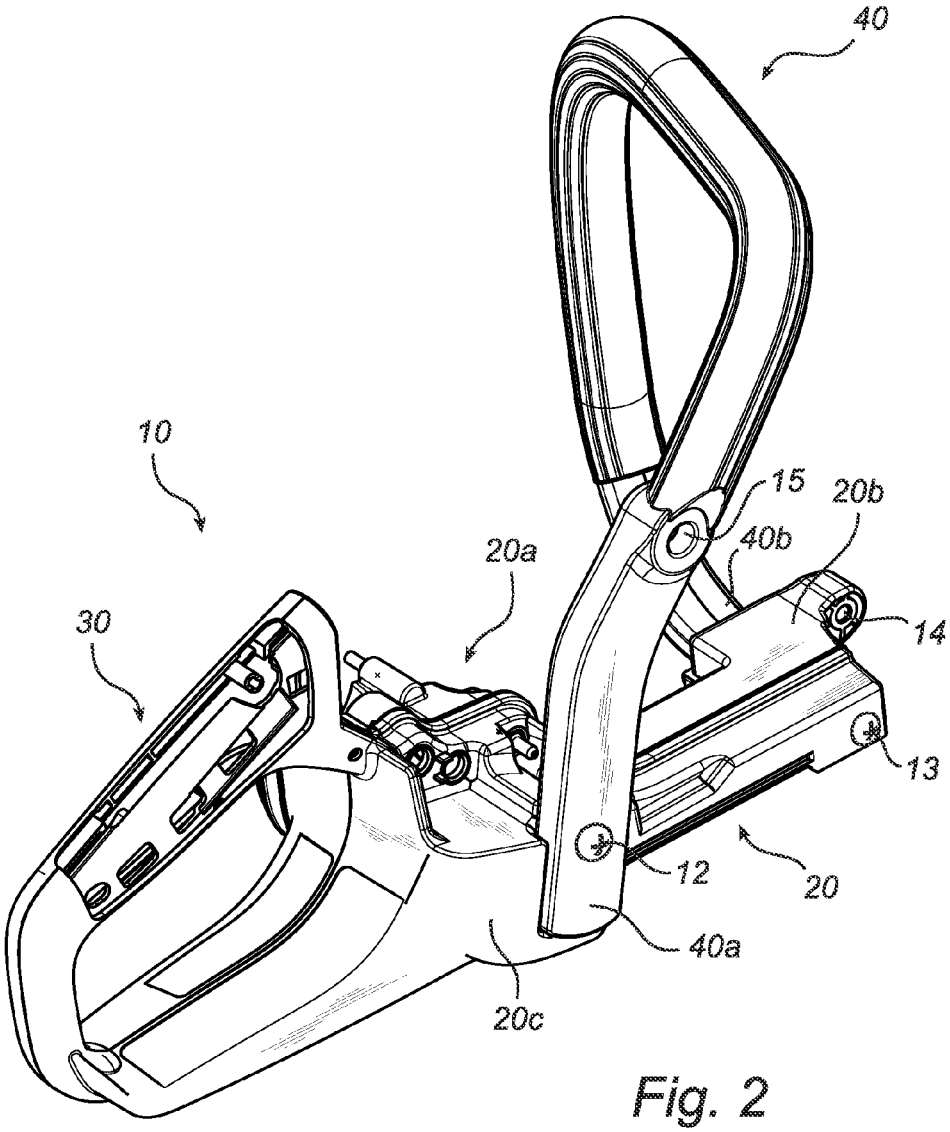
FIG. 2 shows a perspective view from above of a handle portion according to one embodiment of the invention.
Figure 3:
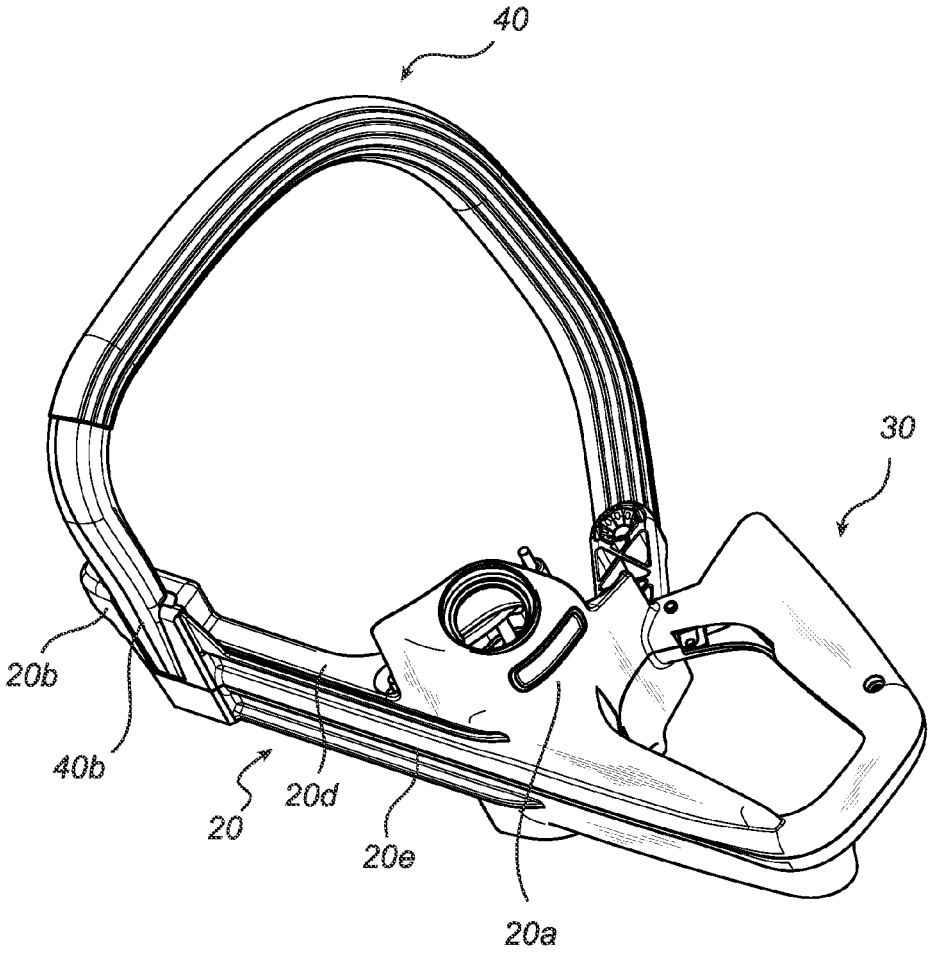
FIG. 3 shows a perspective view from below of another side of the handle portion of FIG. 2.

FIGS. 2 and 3 show a handle portion 10 according to one embodiment of the invention from two different angles. In these figures the front handle 40 has been mounted to the base portion 20. Normally this kind of mounting is performed such that the front handle 40 is mounted to the base portion 20 and to the drive portion 50 of the tool at the same mounting step. In this case, the drive portion is placed on the base portion before the step of mounting the front handle to the base portion and the handle portion to the drive portion. For sake of clarity, the figures only show the mounting of the front handle to the rest of the handle portion. Although, it may also be possible that the front handle 40 is mounted to the base portion 20 in the way shown in the figure, i.e. such that the front handle is first mounted to the base portion before the drive portion 50 is inserted into the handle portion 10 for subsequent mounting of the drive portion to the handle portion.

In FIGS. 2 and 3, the base portion 20 has a lower face 20*e*, which is an underside of the saw, on which the saw is arranged to rest when in its normal rest position. When in the rest position, the lower face 20*e* comes into contact with a surface on which the saw is arranged, for example on the ground or on a table. The base portion 20 further comprises a rear part 20*a* onto which the rear handle 30 is arranged, a front part 20*b* and first and second lateral faces 20*c*, 20*d*. The first and second lateral faces are connected via the lower face 20*e* and an upper face of the base portion. The front handle 40 is arranged with its first end 40*a* to the first lateral face 20*c* at the rear part 20*a* of the base portion 20. The front handle further has a second end 40*b* arranged to the front part 20*b* of the base portion, at the second lateral face 20*d* and the lower face 20*e*. The base portion is further arranged with a hole 14 for receiving a connection means for connecting the handle portion 10 to the drive portion 50. The handle portion may be connected to the drive portion via anti-vibration means.

Further, the first end 40*a* of the front handle is arranged to the rear part of the base portion at the first lateral face 20*c* via a first attachment means 12, such as a screw. Also, the second end 40*b* of the front handle is arranged to the base portion 20 via a second attachment means 13, which for example may be a screw. Both the first and the second attachment means 12,13 are mountable at the base portion at the first lateral face 20*c*. Thereby it will be possible to attach both the first and the second end of the front handle to the base portion without having to turn the handle portion, or in any other way adjust the posture of the handle portion, between mounting of the first and the second attachment means. The front handle also has a hole 15 for receiving a connection means for connecting the handle portion to the drive portion. Observe that also the holes 14, 15 are arranged such that the handle portion can be attached to the drive portion at the first lateral face. As a result, the front handle can be attached to the base portion and the handle portion can be attached to the drive portion without having to change posture of the arrangement when mounting the attachment means and the connection means.

Figure 4:
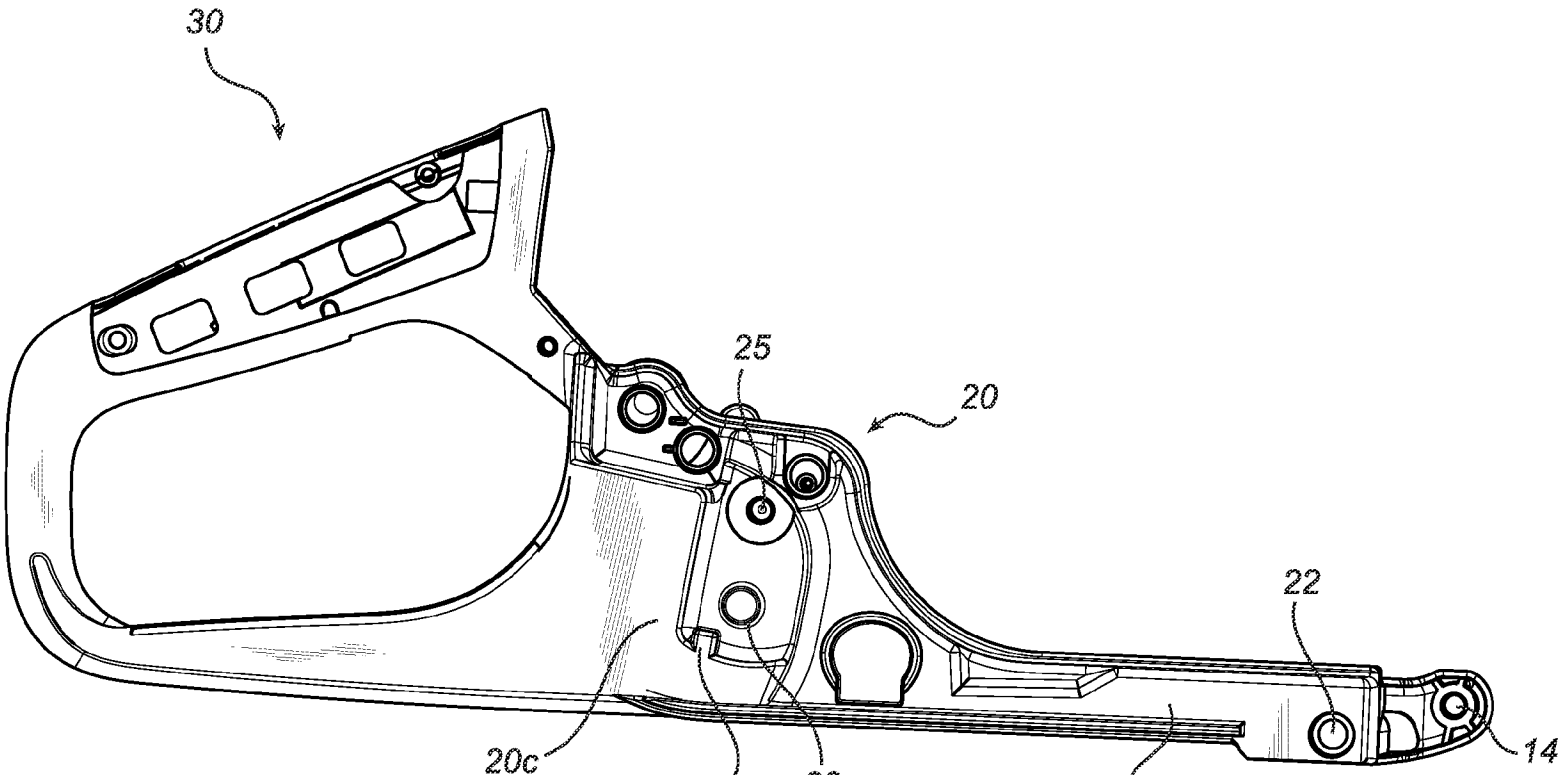
FIG. 4 shows a side view of a base portion and a rear handle of a handle portion according to one embodiment of the invention.

FIG. 4 shows a side view of a base portion according to one embodiment of the invention. The figure shows holes 22, 25 for receiving the first and second attachment means 12, 13. The base portion further has first and second projections 23, 24 arranged on the first lateral face 20*c* at a recessed part of the first lateral face. The projections are arranged to co-operate with cavities 43, 44 arranged in the front handle close to the first end 40*a* of the front handle, see FIG. 7. The projections 23, 24 are preferably arranged on the rear part of the base portion. The projections preferably have different cross-sectional shape. In this example of the invention, the first projection 23 has circular cross-section and the second projection 24 has squared cross-section. In the first lateral face 20*c*, at the rear part of the base portion 20 is also provided a blind bore 25 for receiving the first attachment means 12. The blind bore may or may not be threaded for receiving the first attachment means.

Figure 5:
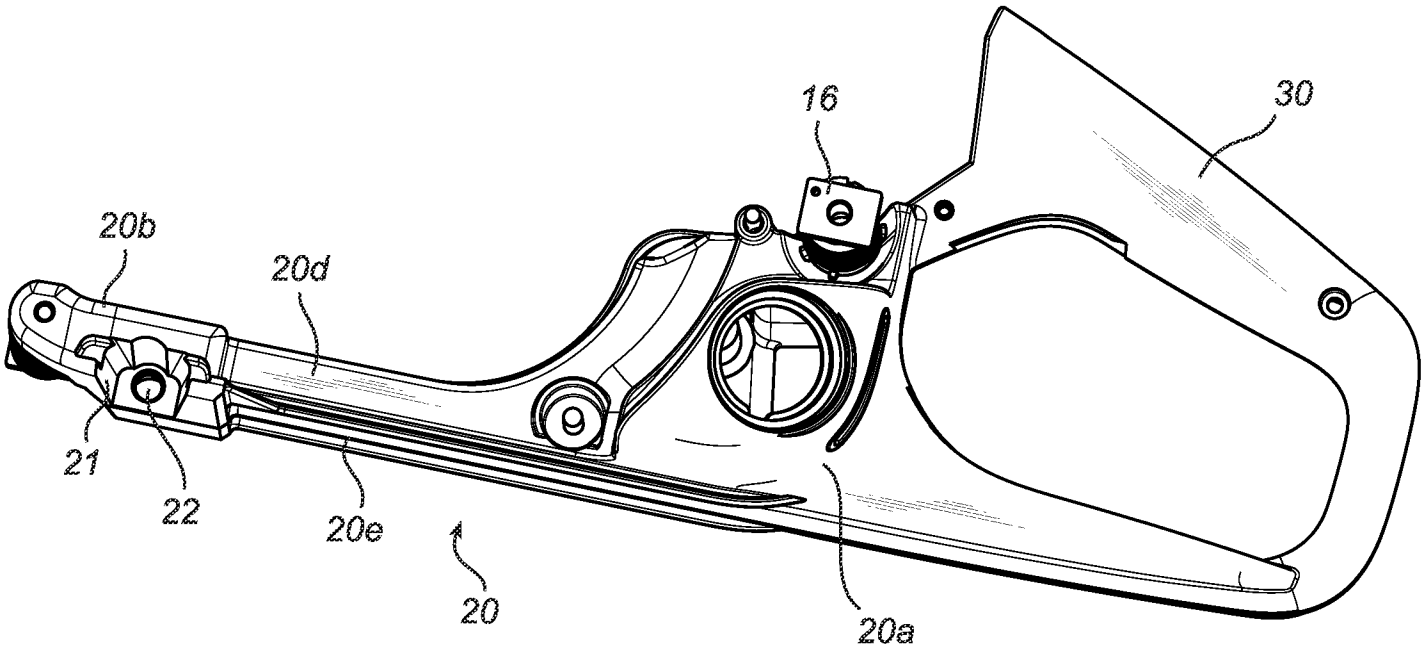
FIG. 5 shows a perspective view from another side of the base portion and rear handle of FIG. 4.

FIG. 5 shows a perspective side view slightly from below in a direction towards the second lateral face 20*d* and the lower face 20*e* of the base portion. The base portion 20 is provided with a recess 21, preferably at its front part 20*b*. The recess 21 is arranged for receiving the second end 40*b* of the front handle. The recess 21 extends into the base portion from the lower face 20*e* in a direction towards the upper face, and from the second lateral face 20*d* in a direction towards the first lateral face 20*c*. In an alternative embodiment, the recess 21 might extend only from the second lateral face 20*d*, i.e. in that case the recess is closed towards the lower face 20*e*. In still another alternative embodiment, the recess might be partially closed towards the lower face.

FIG. 5 also shows an anti-vibration element 16 arranged to the rear part 20*a* of the base portion for connecting the handle portion to the drive portion and for preventing vibrations in the drive portion to propagate into the handle portion.

Figure 6:
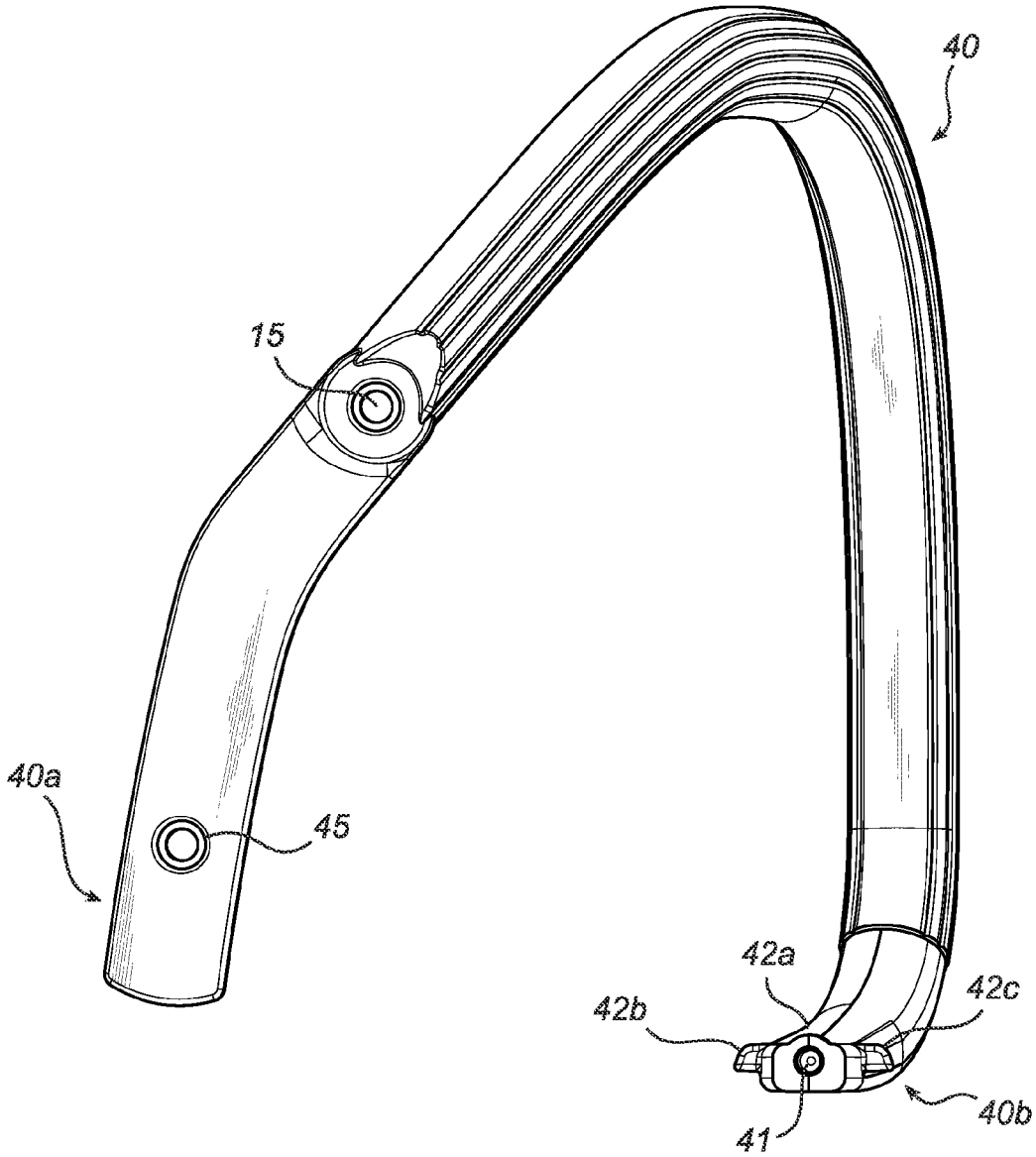
FIG. 6 shows a perspective view of a front handle according to one embodiment of the invention.
Figure 7:
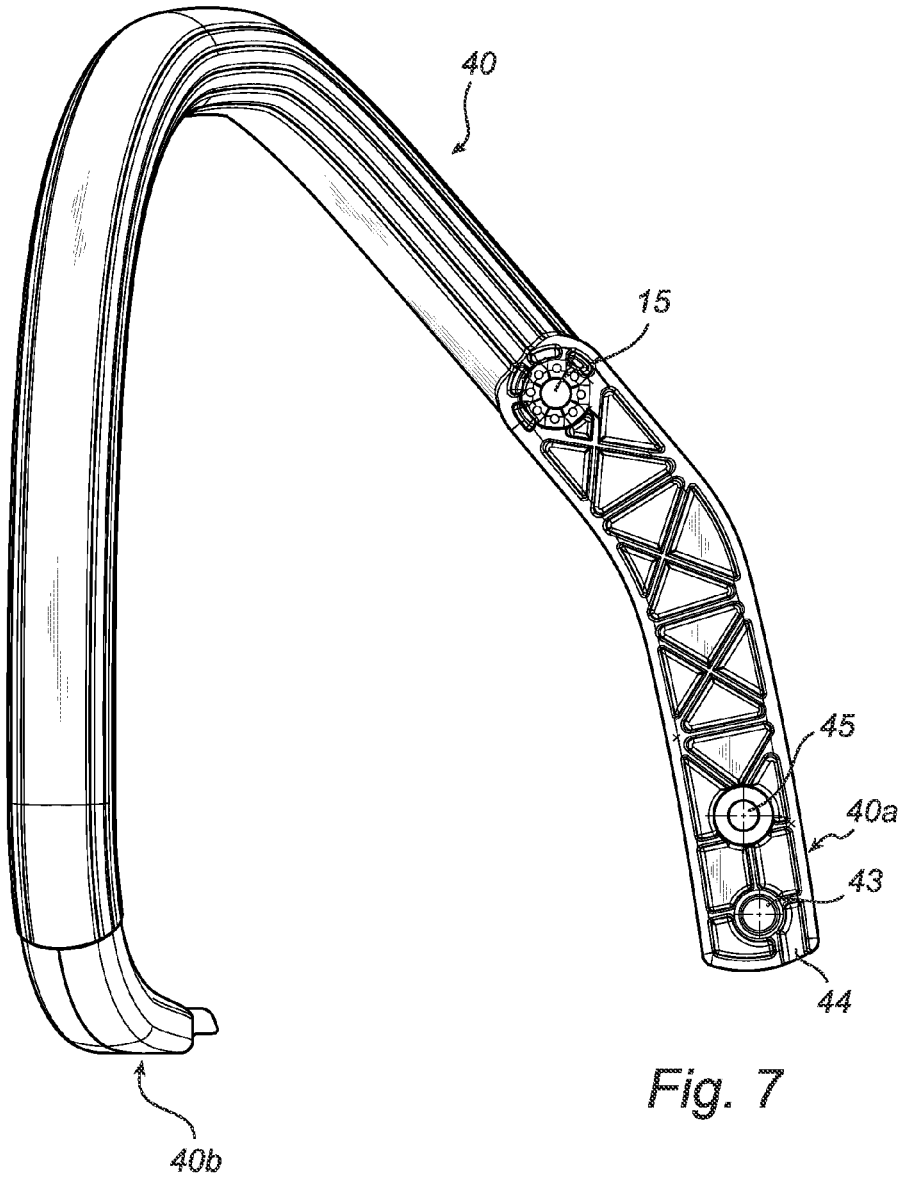
FIG. 7 shows a perspective view from another side of the front handle of FIG. 6.

FIGS. 6 and 7 show different views of a front handle 40 according to an embodiment of the invention. FIG. 6 shows the second end 40*b* of the front handle comprising a blind bore 41 for receiving the second attachment means 13. The blind bore 41 extends into the front handle from an end surface of the second end, preferably in an extension direction of the front handle. The second end 40*b* further comprises first, second and third protrusions 42*a*, 42*b*, 42*c* arranged for co-operation with grooves 21*a*, 21*b*, 21*c* in the recess 21 of the base portion 20, see FIG. 5, and especially FIGS. 8 and 9. The front handle 40 of FIGS. 6 and 7 also comprises a hole 45 for receiving the first attachment means 12 and a hole 15 for receiving a connection means, connecting the handle portion to the drive portion, preferably via an anti-vibration means.

In FIG. 7, the front handle is shown from an angle opposite to the angle shown in FIG. 6. In the front handle close to the first end 40*a* of the front handle, cavities 43, 44 are provided. The cavities have a cross-section selected to correspond with the cross-section of the projections 23, 24 in the base portion 20 (see FIG. 4). I.e. the first cavity 43 has circular cross-section and the second cavity 44 has squared cross-section. Thereby, when the front handle 40 is arranged onto the base portion 20, the arrangement with the corresponding projections and cavities will guide the arrangement of the front handle onto the base portion and prevent any rotating movement of the front handle in relation to the base portion. This arrangement also makes it possible to create a reliable and durable attachment with only one attachment means instead of two attachment means to attach the first end of the front handle to the base portion.

Figure 8:
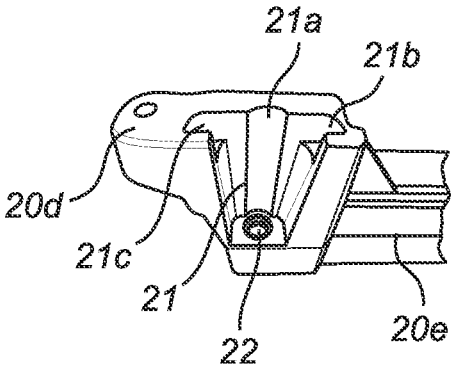
FIG. 8 shows a perspective view of a detail of the base portion according to one embodiment of the invention.
Figure 9:
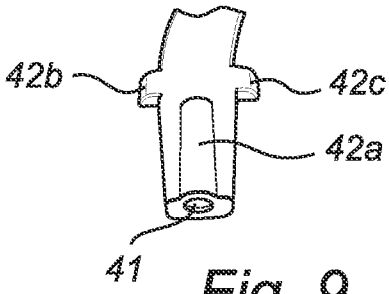
FIG. 9 shows a perspective view of a second end of a front handle according to one embodiment of the invention.

FIG. 8 shows the front part 20*b* of the base portion, comprising the recess 21. FIG. 9 shows the second end 40*b* of the front handle 40. The recess 21 and the second end 40*b* of the front handle are arranged such that they co-operate with each other such that the recess can receive the second end 40*b* of the front handle, thus having dimensions adapted to each other. Further, the recess 21 has a first, flattened groove 21*a* extending along the entire length of the recess 21, from the second lateral face 20*d* in the direction towards the first lateral face 20*c*. The second end 40*b* of the front handle has a corresponding flattened first protrusion 42*a*, arranged to co-operate with the first groove 21*a*, when the second end 40*b* is inserted in the recess. The first protrusion 42*a* has a shorter extension than the corresponding first groove 21*a* of the recess. A purpose with the first protrusion 42*a* is to make it possible to manufacture the second end 40*b* with the blind bore 41, without achieving a too thin material thickness around the blind bore 41. For this reason, the first protrusion of this embodiment has an extension that is at least similar to the extension of the second attachment means 13 into the blind bore.

The recess 21 further has a second and a third groove 21*b*, 21*c*, arranged at opposite sides of the recess. The second 21*b* and third 21*c* grooves are deeper than the first groove 21*a*, and have an extension in the direction from the second lateral face 20*d* towards the first lateral face 20*c*, which is limited to a smaller part of the extension of the recess, the grooves starting from the second lateral face 20*d*. The second end 40*b* of the front handle further has corresponding second and third protrusions 42*b*, 42*c*, arranged to co-operate with the second and third grooves 21*b*, 21*c*, when the second end 40*b* is inserted in the recess 21. The second and third protrusions 42*b*, 42*c* are arranged as wings on opposite sides of the front handle at a distance from an end surface of the second end 40*b* that corresponds to a distance of the second and third grooves from a bottom of the recess, i.e. from the part of the recess that is closest to the first lateral face 20*c*. The arrangement of the second and third protrusions and corresponding second and third grooves creates a solid arrangement of the second end 40*b* in the recess 21, which at the same time makes it easy to insert the second end in the recess by placing the second end in the recess with the second and third protrusions 42*b*, 42*c* just outside the recess, and thereafter pushing the second end 40*b* into the recess 21 such that the second and third protrusions 42*b*, 42*c* are inserted into the second and third grooves of the recess.

The first groove 21*a* and corresponding protrusion 42*a* also aids in creating a more solid arrangement of the second end 40*b* in the recess 21. In addition, the flattened first groove is arranged to make space for the second attachment means without having to increase the thickness of the base portion at the front part 20*b*, i.e. the distance between the lower face 20*e* and an oppositely arranged upper face of the base portion 20. Thereby, material is spared.

The hole 22 in the front part 20*b* of the base portion and the blind bore 41 in the second end of the front handle are arranged such that when the second end of the front handle is inserted in the recess 21 of the base portion, a passage is created by the hole 22 and the blind bore 41 for receiving the second attachment means 13. The blind bore 41 and/or the hole 22 may or may not be threaded for receiving the second attachment means.

In an embodiment of the invention, the base portion 20 houses a fuel tank inside its faces. For this reason, the base portion may be provided with a fuel tank opening.

In the figures, the rear handle 30 is integrally arranged with the base portion 20 such that the rear handle and the base portion are produced as one part. Although, it may also be possible that the rear handle is arranged to the base portion via attachment means, such as screws.

In another alternative embodiment of the handle portion, the front handle 40 may be arranged to the base portion 20 such that the first and second attachment means 12, 13 are mounted to the base portion and the front handle at, or from, the second lateral face 20*d* of the base portion. In this embodiment, the handle portion may for example be inverted compared to the embodiment shown in the figures.

In yet another alternative embodiment, the front handle may also be arranged to the base portion such that the first and second attachment means are mounted to the base portion and the front handle at the lower face 20*e* of the base portion.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A handle portion for a hand-held motor-driven tool, the handle portion comprising:

a base portion having a rear part, a front part, a first lateral face, a second lateral face opposite to the first lateral face, and a lower face connecting the first and the second lateral faces, the lower face being intended to face downwards when the tool is in its normal rest position, a rear handle arranged to the rear part of the base portion;

a front handle having a first end attached to the base portion and a second end inserted into the base portion, and wherein at least a part of the front handle is arranged as a loop starting from the first lateral face of the base portion and extending in a direction away from said lower face of the base portion and further in a direction towards said second lateral face of the base portion;

a first attachment apparatus attaching the first end of the front handle to the base portion;

a second attachment apparatus attaching the second end of the front handle to the base portion, wherein the first attachment apparatus and the second attachment apparatus are mountable at the first lateral face of the base portion, which is provided with a recess for receiving the second end of the front handle, the recess extending from the second lateral face in a direction towards the first lateral face, through a limited portion of the base portion; and the recess of the base portion is provided with grooves, and wherein the second end of the front handle is provided with protrusions, which are arranged to co-operate with the grooves.

2. Handle portion according to claim 1, wherein the recess of the base portion is shaped such that it co-operates with the shape of the second end of the front handle.

3. Handle portion according to claim 1, wherein the grooves comprises a first, flattened groove extending in the direction of the recess along the whole extension of the recess, and wherein the protrusions of the front handle comprises a first protrusion arranged to co-operate with a first groove.

4. Handle portion according to claim 1, wherein the grooves of the recess comprises at least two second grooves arranged substantially opposite to each other, extending in the direction of the recess, and wherein the protrusions of the front handle comprises at least two substantially oppositely arranged protrusions arranged to co-operate with the at least two second grooves.

5. Handle portion according to claim 1, wherein the first end of the front handle is provided with at least one cavity and the base portion is provided with at least one projection arranged to co-operate with the at least one cavity, the cavity and the projection being arranged to correspond with each other.

6. Handle portion according to claim 5, wherein the at least one projection of the base portion comprises at least two projections each having a different cross-sectional shape, and wherein the at least one cavity of the first end of the front handle comprises at least two cavities, each cavity having inner dimensions corresponding with the inner dimensions of one of the projections, such that each cavity co-operate with its corresponding projection.

7. Handle portion according to claim 1, wherein the first end of the front handle is attached to the first lateral face of the base portion and the second end of the front handle is arranged at the lower face of the base portion.

8. Handle portion according to claim 1, wherein the first end of the front handle is attached to the rear part of the base portion, and wherein the second end of the front handle is attached to the front part of the base portion.

9. Handle portion according to claim 1, wherein the base portion has a fuel tank, and wherein the first end of the front handle is attached to a face of the fuel tank.

10. A hand-held motor-driven tool, comprising a drive portion and a handle portion according to claim 1.

11. Hand-held motor-driven tool according to claim 10, wherein the handle portion is arranged to the drive portion via at least one anti-vibration element.

* * * * *